United States Patent [19]

Stone

[11] 4,231,478

[45] Nov. 4, 1980

[54] BULK SORTING OF PARTICULATE MATERIAL

[75] Inventor: Alan M. Stone, Briar Hill, Australia

[73] Assignee: Sphere Investments Limited, Nassau, The Bahamas

[21] Appl. No.: 951,957

[22] Filed: Oct. 16, 1978

[30] Foreign Application Priority Data

Apr. 26, 1978 [ZA] South Africa ..... 78/2389

[51] Int. Cl.[3] ..... B07C 5/00

[52] U.S. Cl. ..... 209/576; 209/638; 209/657; 209/910; 222/58

[58] Field of Search ..... 209/576, 577, 578, 587, 209/589, 580, 581, 582, 579, 910, 638, 639; 222/58

[56] References Cited

U.S. PATENT DOCUMENTS

| | | | |
|---|---|---|---|
| 2,617,526 | 11/1952 | Lapointe | 209/576 |
| 2,717,693 | 9/1955 | Holmes | 209/578 |
| 3,052,353 | 9/1962 | Pritchett | 209/576 |
| 3,075,641 | 1/1963 | Hutter et al. | 209/589 |
| 3,472,375 | 10/1969 | Mathews | 209/589 |
| 3,581,888 | 6/1971 | Kelly | 209/587 |
| 3,655,964 | 4/1972 | Slight | 209/589 |
| 3,901,388 | 8/1975 | Kelly | 209/587 |
| 3,977,526 | 8/1976 | Gordon | 209/587 |
| 4,099,620 | 7/1978 | Kendall | 209/638 |

*Primary Examiner*—Allen N. Knowles

*Attorney, Agent, or Firm*—Cushman, Darby & Cushman

[57] ABSTRACT

Method and apparatus for bulk sorting particulate material such as ore rocks. A conveyor belt carries the material in a continuous stream past a detector responsive to a required characteristic to produce a time sequence of detector signals dependent on degree to which material passing the detector possesses that characteristic. The material is projected from the downstream end of the conveyor belt into free flight trajectory and a deflector plate is moved across the face flight path so that material in some zones of the stream is deflected whereas material in other zones is not deflected. A control circuit monitors the detector signals and causes the deflector plate to move so that said zones are determined by the degree to which the material in them possesses the required characteristic.

9 Claims, 2 Drawing Figures

34
36
11 14 16 17
18
51
48
54
53
52
50 49
37
22
10
26 24
13 15
35 38
39
27
28 23 19 21
12 25
36
31
33
41
37
22
19
21
24 26
32
27
28 23
43
33
20
46
44
47
42
10
45

BULK SORTING OF PARTICULATE MATERIAL

BACKGROUND OF THE INVENTION

This invention relates to the sorting of particulate material and has particular, but not exclusive, application to sorting of ore rocks.

It is known to sort ore rocks by passing the rocks one by one past a detector which determines the degree to which each rock possesses a required characteristic and then diverting or deflecting individually selected rocks from a main stream. The rocks may for example, be projected in a free flight path and the selected rocks deflected from that path by air blasts or other deflection means. This method of sorting is very accurate but requires very large and expensive apparatus to achieve a high throughput of material.

The present invention provides a method and apparatus whereby particulate material can be selected on a bulk basis rather than on a particle by particle basis. There are many applications where such bulk sorting is satisfactory, particularly when dealing with material of relatively small particle size. The present invention enables sorting to be carried out in such cases with relatively small and inexpensive equipment.

SUMMARY OF THE INVENTION

The invention provides a method of sorting particulate material into fractions according to the degree to which that material possesses a certain characteristic, comprising passing said material in a continuous stream past a detector responsive to said characteristic whereby to derive a time sequence of detector signals dependent on the degree to which material passing the detector exhibits said characteristic, making use of said detector signals to attribute to contiguous zones of material in said stream differing intensities of said characteristic, and dividing the streams into separated material fractions such that material of differing zones is separated into different fractions.

The stream may be divided into two fractions such that material in the zones of the stream possessing such characteristic above a predetermined degree are separated into one fraction and material in zones possessing said characteristic below the predetermined degree are separated into the other fraction.

The stream may be divided by projecting the stream into a free flight path and moving a material deflector transversely of the path such that material of some of the zones are deflected from said path and material of other zones is not so deflected.

The invention also provides apparatus for sorting particulate material into fractions according to the degree to which that material possesses a certain characteristic comprising means to move said particulate material in a continuous stream along a path;

a detector positioned such that material moving in said stream along said path will pass it and responsive to said characteristic so as to produce a time sequence of detector signals dependent on the degree to which material passing the detector possesses said characteristic;

control means to receive said detector signals and to derive therefrom control signals indicative of contiguous zones of material in the stream possessing said characteristic to differing degrees; and stream divider means operative in response to said control signals to divide the stream into separated material fractions such that material of differing zones is separated into different fractions.

BRIEF DESCRIPTION OF THE DRAWINGS

In order that the invention may be more fully explained one particular embodiment will be described with reference to the accompanying drawings in which.

DESCRIPTION OF PREFERRED EMBODIMENT

Figure 1:
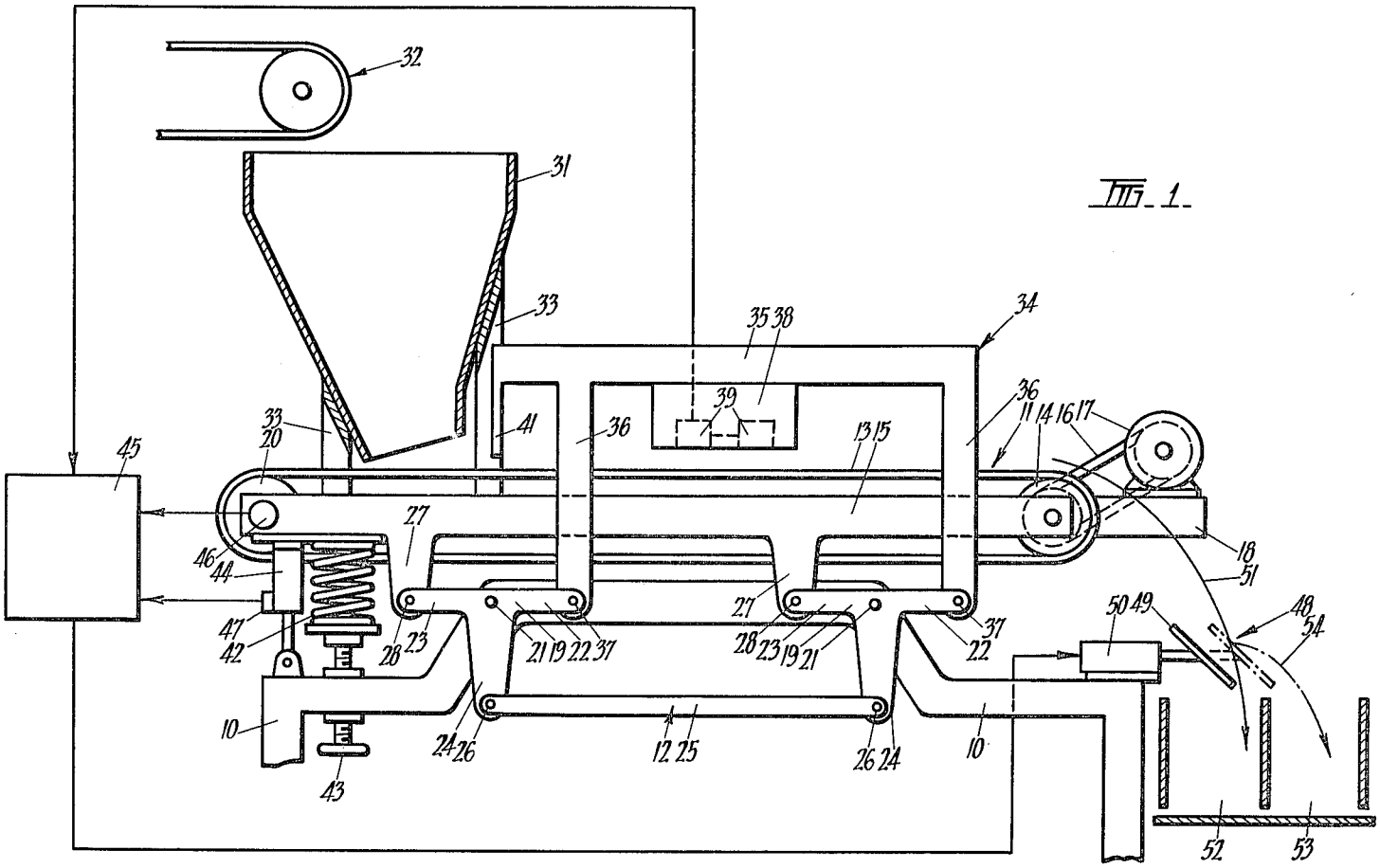
FIG. 1 is a diagrammatic illustration of bulk sorting apparatus constructed in accordance with the invention.

The illustrated apparatus comprises a main frame 10 which supports a belt conveyor 11 through a linkage system denoted generally as 12. Belt conveyor 11 comprises an endless conveyor belt 13 extended around pulleys 20, 14 mounted on a conveyor frame 15. Pulley 20 is an idler and pulley 14 is driven via a drive belt 16 by means of an electric motor 17 mounted on an extension 18 of the conveyor frame 15. Conveyor belt 13 can thus be driven by operation of electric motor 17 such that its upper run moves from left to right as seen in FIG. 1.

Linkage system 12 comprises a pair of linkages each supporting one side of the conveyor 11 and each comprised of two T-shaped cranks 19 pivotally connected by pins 21 to the main frame 10. Each crank 19 has horizontally opposed arms 22, 23 and a vertically depending arm 24 and lower ends of the two arms 24 of each linkage are interconnected by a generally horizontal link 25, the two ends of link 25 being connected to the respective crank arms 24 by pivot pins 26.

Conveyor frame 15 is formed with downwardly depending lugs 27, the lower ends of which are pivotally connected by pivot pins 28 to the outer ends of crank arms 23. Linkage system 12 thus serves as a movable support for belt conveyor 11 whereby the belt conveyor can move substantially vertically upon swinging movement of the cranks 19.

A feed surge hopper 31 is disposed above the feed end of conveyor belt 13 to receive material which is to be sorted from a delivery belt conveyor 32. Feed hopper 31 is mounted by legs 33 on the conveyor frame 15 so as to be movable vertically with conveyor 11 relative to main frame 10.

The arms 22 of cranks 19 support a yoke frame 34 having an upper section 35 and vertical legs 36 which are connected at their lower ends by pivot pins 37 to the outer ends of the crank arms 22. Yoke frame 34 carries a box 38 which houses detector means responsive to a characteristic of the material to be sorted. The detector means may comprise a plurality of scintillation detector units 39 to detect radioactivity of material transported on the conveyor belt. In this case box 38 will also house heavy lead shielding to shield against background or stray radiation.

Yoke frame 34 also carries a vertical gate 41 to control the level of material flowing from hopper 31 on to the conveyor belt 13. This gate may be vertically adjustable on frame 34 to allow the depth of material on the belt to be altered for a given position of the conveyor relative to frame 34.

Since yoke frame 34 is mounted on crank arms 22 which are opposed to the arms 23 carrying the belt conveyor 11 and hopper 31, the weight of the frame 34 and its attachments tends to counter-balance the weight of conveyor 11 and hopper 31 on cranks 19. Moreover, a downward movement of conveyor 11 under the influence of increased weight of accumulated material in hopper 31 will cause a corresponding upward movement of frame 34 and with it the detector means 39 and the feed control gate 41.

The initial position of conveyor belt 11 is set by a helical spring 42 acting between the underside of conveyor belt frame 15 and the main frame 10 via a screw adjustment 43. Thus downward movements of the conveyor belt under the influence of an increase of weight of accumulated material within the hopper 31 is resisted by spring 42 which returns the conveyor belt upward when the weight of accumulated material decreases. These movements of the conveyor are damped by a dash-pot damper 44 installed adjacent spring 42 to act beneath the underside of conveyor belt 15 and main frame 10.

Since the conveyor 11 and feed control gate 41 are moved vertically in opposition to one another according to the weight of material in hopper 31, the depth of the material transported by the conveyor belt beneath the detector means 39, and therefore the flow rate of transported material, is proportional to the weight of accumulated material in hopper 31. Thus the throughput of material is automatically varied to compensate for fluctuations in the rate of delivery from delivery conveyor 32 but the detector means 39 will remain at a fixed distance above the upper surface of the material on the belt.

Scintillation detector units 39 are arranged to continuously scan bands or channels of the continuous stream of material transported beneath them by the conveyor belt. Although the material is not physically divided into bands the detector units are grouped across the width of the belt to form a number of detectors each monitoring a longitudinal band or channel of material. As indicated in FIG. 1 the detector for each channel may comprise a pair of detector units spaced along the channel and connected in series to accumulate the resulting scintillation counts. These counts are fed via a line 44 to a control circuit 45. The control circuit 45 also receives signals from a tachometer 46 which monitors the speed of the belt and further signals from a transducer 47 which monitors the position of conveyor belt frame 15 relative to main frame 10.

Scintillation detectors 39 produce a time sequence of signals dependent on the radiation received from the material passing beneath them. Control circuit 45 operates to modify or weight these signals according to the vertical position of the conveyor belt as indicated by the signals or transducer 47 in order to make allowance for the amount of material contributing to the signal generation and thereby to derive an indication of radiation intensity or density which can be attributed to the material. Circuit 45 analyzes the weighted signals to identify zones of material on the belt having differing degrees of radioactivity and to produce output signals which control the operation of a material stream divider means denoted generally as 48 in the manner described below.

Material reaching the forward end of belt conveyor 11 is projected in a free flight trajectory 51 toward the stream divider means 48. Stream divider means 48 comprises a deflector plate 49 for each of the channels of material scanned by a detector and movable transversely of the free flight trajectory of the material by operation of a hydraulic or pneumatic cylinder unit 50 under the control of the control signals from circuit 45. When cylinder unit 50 is retracted deflector plate 49 is withdrawn from the path of the material which therefore falls downwardly into a first collecting bin 52. When cylinder unit 48 is extended deflector plate 49 is moved into the path of the material which is then deflected into a second bin 53 as indicated by the broken arrow 54.

Figure 2:
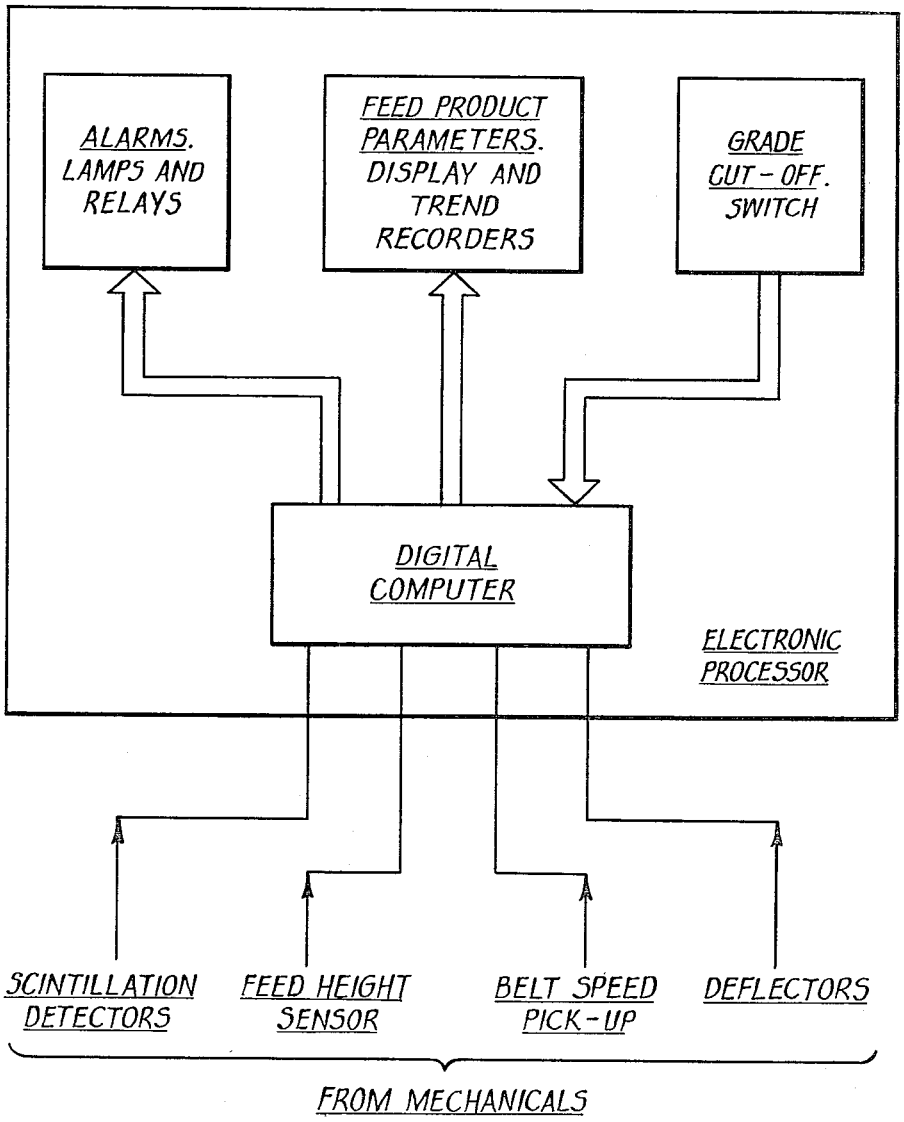
FIG. 2 is a block circuit diagram of electrical control circuitry associated with the apparatus of FIG. 1.

Control circuit 45 is illustrated in block form in FIG. 2. The basis of this circuit is a general purpose digital computer which processes scintillation detector, feed height and control panel switch inputs and controls the deflectors and alarms. In addition, the computer calculates feed and product parameters for displays and trend recorders.

In operation of the illustrated apparatus the material to be sorted is examined not particle by particle but on a zone or bulk basis and very high throughputs can be achieved with apparatus of quite moderate size. Moreover, the quantity of material fed through apparatus is varied according to the weight of the material in surge hopper 31 to compensate for fluctuations in the rate of delivery from delivery conveyor 32. The apparatus can therefore process in a steady manner material arriving intermittently or at a widely fluctuating rate. However, this particular apparatus has been advanced by way of example only and it could be modified considerably. For example, the feed control gate 41 and the scintillation detectors could be mounted on the main frame so that only the conveyor belt and feed hopper move vertically according to the weight of material accumulated in hopper 31, but the illustrated arrangement is preferred since the counter-balance effect reduces the loading on return spring 42. Moreover, the vertical movements of the conveyor necessary to achieve feed control are reduced so that a relatively short and stiff return spring can be used. Variations in the trajectory of the material projected from the end of the belt due to vertical movement of the conveyor is also reduced.

Although the illustrated apparatus operates to divide the material into two fractions it will be appreciated that a further deflector plate or set of deflector plates could be provided to allow the material to be divided into three or more fractions. For example, a further deflector plate could be provided at the mouth of bin 52 to cause a deflection of part of the material which is not deflected by deflector plate 49. The control circuitry can, of course, be set to identify any number of zones of varying radioactivity in the moving stream of material on the conveyor belt. Moreover, the invention is not limited to sorting on the basis of radioactivity and the material could be scanned for other characteristics such as magnetic permeability, resistivity or optical properties.

It is accordingly to be understood that the invention is in no way limited to the details of the preferred embodiment and that many modifications and variations will fall within the scope of the appended claims.

I claim:

1. Apparatus for bulk sorting particulate material into fractions according to the degree to which that material possesses a certain characteristic comprising means to move said particulate material in a continuous stream along a path, said means including a generally horizontal belt conveyor mounted on movable support means so as to be vertically movable and material feed means which comprises a hopper to receive material to be sorted and which, in operation of the apparatus, feeds material from the hopper onto the belt conveyor at a rate which varies according to the vertical position of the conveyor belt, the vertical position of the conveyor belt being dependent on the weight of feed material in said hopper;

a detector positioned such that material moving in said stream along said path will pass it and responsive to said characteristic so as to produce a time sequence of detector signals dependent on the degree to which material passing the detector possesses said characteristic;

control means to receive said detector signals and to derive therefrom control signals indicative of contiguous zones of the bulk material in the stream possessing said characteristic to differing degrees; and stream divider means operative in response to said control signals to divide the stream of bulk material into separated material fractions such that material of differing zones is separated into different fractions.

2. Apparatus as claimed in claim 1, wherein the hopper is mounted together with the belt conveyor on said movable support means so as to move vertically with the belt conveyor.

3. Apparatus as claimed in claim 1, wherein the material feed means comprises a gate disposed above the belt conveyor downstream from the hopper to determine the level of the upper surface of said stream of material on the belt conveyor.

4. Apparatus as claimed in claim 1, wherein the detector is disposed above the belt conveyor and is mounted so as to be spaced at a fixed distance above the upper surface of said stream of material regardless of the vertical position of the belt conveyor.

5. Apparatus as claimed in claim 3, wherein the gate and the detector are incorporated in a structure movable vertically in opposition to the belt conveyor.

6. Apparatus as claimed in claim 5, wherein said structure is mounted on means which biases the belt conveyor upwardly under the influence of the weight of that structure.

7. Apparatus as claimed in claim 1, wherein in operation of the apparatus said stream of material is projected from said path in a free flight trajectory and the stream divider means comprises a deflector disposed at a deflector station along said trajectory and means operative in response to said control signals to move the deflector transversely of said trajectory so that material of some of said zones is deflected from said trajectory and material of other zones is not so deflected.

8. Apparatus as claimed in claim 1, wherein the means to move the material in said continuous stream comprises a belt conveyor, a hopper to receive material to be sorted and to deliver that material to the belt conveyor to form said continuous stream on the belt conveyor, and flow rate control means to vary the rate of material flow in said stream in accordance with the amount of material in the hopper.

9. Apparatus as claimed in claim 8, wherein the flow rate control means is responsive to changes in the weight of said material in the hopper.

* * * * *